US008513573B2

(12) United States Patent
Distaso et al.

(10) Patent No.: US 8,513,573 B2
(45) Date of Patent: Aug. 20, 2013

(54) OVEN WITH IMPROVED FUNCTIONALITY DURING GRILLING

(75) Inventors: Tamara Distaso, Gemonio (IT); John Doyle, Buguggiate (IT); Ermanno Buzzi, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 1031 days.

(21) Appl. No.: 12/499,856

(22) Filed: Jul. 9, 2009

(65) Prior Publication Data

US 2010/0006559 A1 Jan. 14, 2010

(30) Foreign Application Priority Data

Jul. 10, 2008 (IT) ..... MI2008A001260

(51) Int. Cl.

| | |
|---|---|
| ***F24C 7/06*** | (2006.01) |
| ***F27D 11/02*** | (2006.01) |
| ***A21B 1/14*** | (2006.01) |
| ***A21B 1/22*** | (2006.01) |

(52) U.S. Cl.

USPC ..... 219/404; 219/411

(58) Field of Classification Search

None

See application file for complete search history.

(56) References Cited

U.S. PATENT DOCUMENTS

| | | | | |
|---|---|---|---|---|
| 3,161,755 | A * | 12/1964 | Tilus | 219/403 |
| 3,241,545 | A | 3/1966 | Reinert | |
| 3,281,575 | A * | 10/1966 | Ferguson, Jr. | 219/404 |
| 3,450,025 | A | 6/1969 | Fleming | |
| 5,793,023 | A * | 8/1998 | Hong et al. | 219/685 |
| 6,100,503 | A * | 8/2000 | Sasaki et al. | 219/411 |
| 6,384,381 | B2 * | 5/2002 | Witt et al. | 219/411 |
| 7,317,174 | B2 * | 1/2008 | Lau et al. | 219/404 |
| 2009/0272728 | A1 * | 11/2009 | Abbott | 219/399 |

FOREIGN PATENT DOCUMENTS

| | | | |
|---|---|---|---|
| EP | 0076031 | A2 | 4/1983 |
| EP | 819891 | A2 * | 1/1998 |
| GB | 2289607 | A | 11/1995 |
| JP | 3001016 | A | 1/1991 |
| WO | 2008015183 | A2 | 2/2008 |

OTHER PUBLICATIONS

European Publication No. EP09164619 dated Sep. 11, 2009. European Application No. 09164619.0, applicant: Whirlpool Corporation, Viale G. Borghi 27, Comerio, Italy 21025.

* cited by examiner

*Primary Examiner* — Joseph M Pelham

(57) ABSTRACT

An oven comprising a box housing with an internal cavity bounded by walls, and provided on one side with an opening closable by a movable door, at least one of the walls there being provided a browning or grilling member comprising an electrical resistance element, and presenting a first side facing the wall and a second side, opposite the first side, facing the interior of the oven cavity in which at least one food item is positioned to be subjected to cooking and/or grilling, this latter function being obtained by activating the member. In a position corresponding with first side of the grilling member a flat element is provided presenting two opposing flat faces, a first face presenting high emissivity and the second face presenting high reflectivity or reflective power, the element being able to be moved relative to the member such that this latter can be faced by the first face or the second face, depending on the type of cooking required for the food item positioned within the oven cavity.

8 Claims, 1 Drawing Sheet

OVEN WITH IMPROVED FUNCTIONALITY DURING GRILLING

BACKGROUND OF THE INVENTION

1. Field of the Invention

The present invention relates to an oven in accordance with the introduction to the main claim.

2. Description of the Related Art

A usual oven provided with a browning or grilling member (known hereinafter simply as "grill") comprises a box structure or housing comprising side walls, a rear wall, an upper wall and a lower wall, the walls bounding and defining an oven cavity presenting an opening at which a movable part is present.

In proximity to one of these walls, usually the upper wall, the grill is provided, having the form of an electrical resistance element, normally a tubular resistive element or a radiant electrical element; this grill presents a first side facing the top of the oven, and a second side (opposite the first), facing the interior of the oven cavity to hence irradiate a food item positioned therein (for example on a usual grid or support) and subject it grilling or surface browning.

Usually the cavity walls of a commercial oven are of metal covered with a layer of porcelain enamel having a certain emissivity level resulting in a compromise in the food cooking performance between oven cooking functions and grill cooking functions. This emissivity is typically within the range between 0.8 and 0.9. Moreover, these enamelling technologies are associated with complexity and production costs more compatible with mass production, and consequently widely used.

These oven wall characteristics, in particular of the upper wall, which is most influenced by the grill element, are therefore not optimal for each of the individual cooking modes in that, with regard to the grilling function, the energy radiated by the first side of the grill is absorbed in large percentage by the emissive material of the upper wall faced by that side. This reduces the oven radiation efficiency, whereas for "oven" cooking functions the emissivity of that oven wall in proximity to the heating element is not high enough to obtain optimal heating uniformity of the the oven wall, to which optimal cooking performance corresponds. In other words, a normally emissive wall enables only a minimal portion of the energy radiated by the first side of the grill irradiates the food item which, in contrast, receives virtually only the energy radiated by the second grill side, whereas the wall is not heated in an optimally uniform manner for the "oven" cooking functions.

All this limits the oven functionality, so prolonging the time required for cooking and for obtaining a browning or grilling effect on the food item.

Radiation reflector elements are also known as accessories to usual ovens provided with ceramic-covered walls, which improve only the grilling function, while leaving the oven cooking performance unvaried.

SUMMARY OF THE INVENTION

An aspect of the present disclosure is to describe an oven of high utilization efficiency both when used for "oven" cooking of food items and when used for their grilling or browning, the high efficiency enabling both the energy used for grilling and its obtainment time to be reduced.

A further aspect is to disclose an oven which is simple to use by a user and which can be produced by the known technologies currently used for oven production.

These and other aspects which will be apparent to the expert of the art are attained by an oven in accordance with the accompanying claims.

BRIEF DESCRIPTION OF THE DRAWINGS

The present invention will be more apparent from the accompanying drawings, which are attached by way of non-limiting example and in which.

DETAILED DESCRIPTION OF THE PREFERRED EMBODIMENTS

Figure 1:
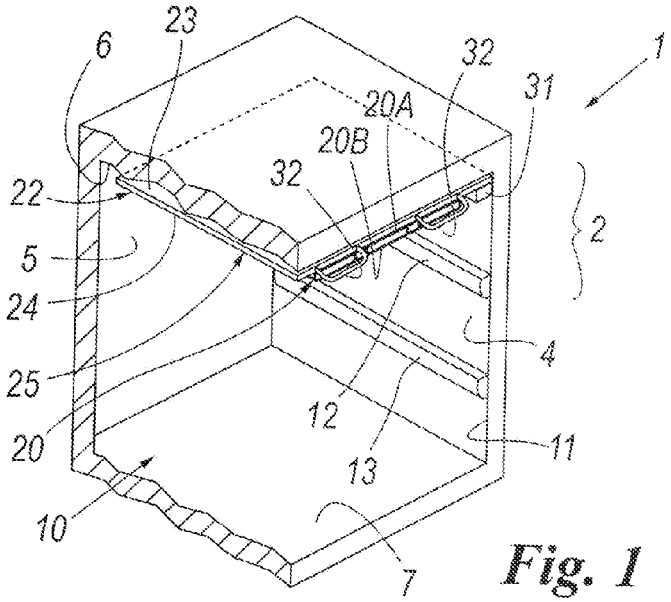
FIG. 1 is a schematic cut-away view, with some parts omitted for greater clarity, of an oven formed in accordance with the invention.

With reference to the figures, an oven 1 comprises a box housing 2 comprising side walls 3, 4, a rear wall 5, an upper wall 6 and a lower wall 7. These walls define and bound an oven cavity 10 accessible through an opening 11 in the housing 2 which is closable by a door (not shown). Usual ledges 12 and 13 are present on the side walls 3 and 4 to hold a grid 15 for supporting a food item to be subjected to cooking in the oven and to grilling or browning. This latter effect is obtainable by a grill 20 positioned at the upper wall 6 of the housing 2, the grill being defined by an electrical resistance element. It should be noted that this grill can be accessible from the cavity 10 (as in the figures) or positioned beyond an aperture in a separator baffle interposed between the grill and the cavity. In both cases, the grill comprises a first side 20A facing the oven upper wall 6 and a second side 20B facing the interior of the cavity 10.

According to this disclosure, a substantially flat element 22 is positioned, movable relative to the grill, between the first side 20A of the grill 20 and the upper wall 6, and presents two substantially flat opposing faces 23 and 24 of different behaviour towards the infrared radiation (IR) emitted by the grill. In particular, of the element 22, the face 23 is of high emissivity and the face 24 is of high reflective power or reflectivity. These faces are identified in any known manner, for example by suitable inscriptions on the element 22.

Figure 2:
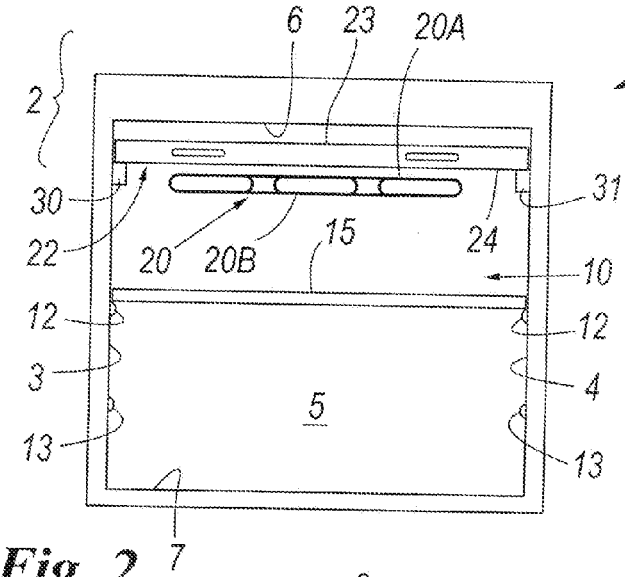
FIG. 2 is a front view of the oven of FIG. 1.
Figure 3:
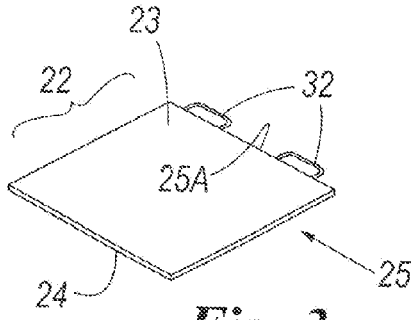
FIG. 3 is a perspective view of a detail of the oven of FIG. 1.

In a first embodiment (FIGS. 1-3), the flat element 22 presents a rigid body 25, extractable from the cavity 6 or at least movable relative to the grill 20 along guides 30, 31 provided on the opposing side walls 3, 4 of the oven. For this purpose, the body 25 presents two gripping handles 32 projecting from a front face 25A of the body which faces the opening 11 of the cavity 10, the handles facilitating the movement.

Also, the first face 23 of the element 22 has a high emissivity $\epsilon$, equivalent to or greater than that of the other oven walls 3, 4, 5 and 7, lying within the range 0.94 to 0.98 and preferably around 0.96, to be hence functional for "oven cooking" the food item positioned in the cavity 10. This face 23 faces the cavity interior and hence towards the first side 20A of the grill 20 when this latter is deactivated and the food item is to be prepared by "oven cooking".

This high emissivity is obtained, for example, by appropriate facial treatment, substantially anodization, which produces a controlled growth of the oxide layer and of its porosity, such as the "Fujihokka" treatment developed by the Fujihura Company for aluminium articles.

In contrast, the second face 24 of the flat element 22 is of high reflectivity or reflective power, which is in inverse proportion to emissivity and is obtained, for example, by suitably choosing the surface material (for example aluminium) or by coating the face 24 with such material by processes of physical vapour deposition (PVD) or chemical vapour deposition (CVD) type, followed by subsequent finishing, for example polishing. The low emissivity value e1 corresponding to the high reflectivity value of the second face 24 is less than 0.03 and preferably around 0.06.

This face is hence functional in grilling the food item placed in the cavity 10: it is positioned in front of the first side 20A of the grill 20 and reflects the radiation IR generated by it towards the interior of the cavity. In this manner, radiant energy which would otherwise be unused or used less efficiently in grilling if the element 22 had its first face 23 facing the grill, is in this manner effectively utilized by virtue of the high reflective power of the second face 24 of the element 20 which now faces the grill.

The faces 23 and 24 can be arranged differently relative to the grill by firstly moving the flat element 22 along the guides 30, 31 and extracting it from the oven 1 (so as to be able to then rotate it through 180° in order to position a different face in front of the first side 20A of the grill 20).

Figure 4:
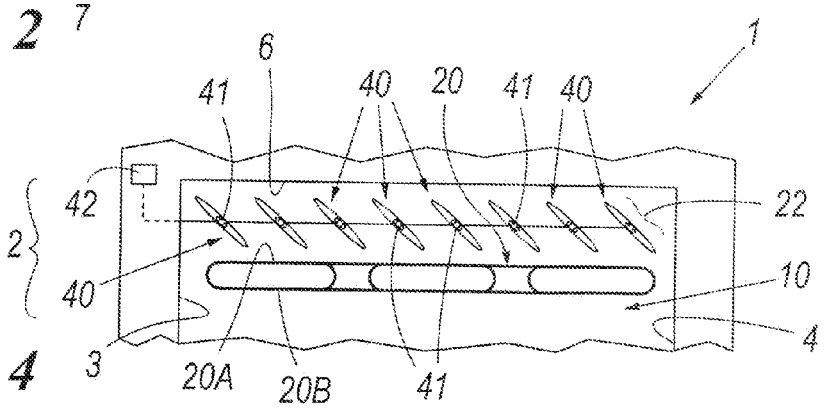
FIG. 4 is a partial front view, with some parts omitted for greater clarity, of a variant of the oven according to the invention.

In a different embodiment (FIG. 4), the element 22 is in the form of a "Venetian blind" and defined by a plurality of parts 40 rotating about their axis 41 (the axes being all mutually parallel and lying in the same plane) and remotely operated by an actuator member 42, which can be electrically or manually operated (for example it can be a stepping modem which via suitable mechanical transmissions rotates the parts 40 about the axes 41). Each part is substantially flat and presents opposing faces which, when these elements are in a position parallel to the oven wall 6, define the faces 23 and 24 of the element 22. In a further embodiment, the parts 40 can be arranged and rotated such as to form a surface of high emissivity or of high reflective power having a shape which is not flat but instead is similar to a parabolic surface or a surface with elliptical curvature to better focus the IR radiation on the food item.

In other embodiments of the invention the oven is provided with a plurality of elements applicable to and removable from the other oven walls.

A description will now be given of the equipment and procedure used to measure the material (e) value by thermography.

Thermographic machine: ThermaCAM TM 500 Flir System

Procedure:

1) Set $\epsilon$=1 on the thermograph SW.
2) Measure the ambient temperature (mean) using measurements made on a portion of aluminium foil.
3) Position a piece of insulating PVC tape ($\epsilon$=0.95) on the material to be measured.
4) Heat the object until its temperature is at least 30/40° C. above ambient temperature.
5) Measure the temperature (with the thermography slider) on the PVC piece.
6) Move the thermograph temperature measurement slider to a point on the material close to the PVC, and measure the temperature T. Vary the $\epsilon$ in the set parameters window until the same temperature value as the PVC is read off. The new emissivity value $\epsilon$ is that of the material to be measured.
7) Carry out temperature measurements with the thermograph on the material or object with the new emissivity value.

This enables the oven to be used in an improved and more functional manner, when used both for oven cooking and for grilling.

We claim:

1. An oven, comprising:

an internal cavity bounded by walls, at least one of the walls including a browning or grilling member, the browning or grilling member comprising an electrical resistance element, and a substantially flat element having a first side facing the wall and a second side configured opposite the first side facing wall and facing the interior of the oven internal cavity, the internal cavity configured to receive a food item positioned for at least one of a cooking and a grilling, wherein the grilling is obtained by activating the grilling member, wherein the first face of the browning or grilling member has a high emissivity, relative to the internal cavity walls, the second face of the element has a low emissivity, relative to the internal cavity walls, the element configured to move relative to the internal cavity such that the grilling can be faced by the first face or the second face, depending on the type of cooking required for the food item positioned within the oven cavity.

2. The oven according to claim 1, wherein the element comprises a rigid flat body movable along guides inside the oven and extractable from the grilling such that the arrangement of its two faces can be modified relative to the grilling member.

3. The oven according to claim 1, wherein the element is defined by a plurality of parts rotatable about their axis by means of an actuator, each of the parts presenting two opposing faces which define the first and second side faces of the element on the basis of the spatial position of the parts relative to the grilling member.

4. The oven according to claim 3, wherein the axes about which the parts defining the element rotate are mutually parallel and lie in one and the same plane.

5. The oven according to claim 3, wherein the axes about which the parts defining the element rotate are positioned along a curved line such that the parts are able to define a curved surface relative to the grilling member.

6. The oven according to claim 1, wherein the first side face of the element movable relative to the grilling member is anodized or enamelled or coated with ceramic-based coatings.

7. The oven according to claim 1, wherein the second face of the element movable relative to the grilling member is surface-worked to achieve a high reflective power.

8. The oven according to claim 1, wherein the element movable relative to the grilling member presents markings on its two faces which define their emissivity and/or reflective power characteristics.

* * * * *